US005527254A

United States Patent [19]

Taliaferro

[11] Patent Number: 5,527,254

[45] Date of Patent: Jun. 18, 1996

[54] METHOD OF MAKING A KNOCKED-DOWN FLAT PREFORM FOR A SHIPPING AND DISPLAY CONTAINER

[75] Inventor: Diale Taliaferro, Battle Creek, Mich.

[73] Assignee: Kellogg Company, Battle Creek, Mich.

[21] Appl. No.: 231,313

[22] Filed: Apr. 22, 1994

[51] Int. Cl.[6] ..... B31B 1/26

[52] U.S. Cl. ..... 493/180; 493/181; 493/177; 493/178

[58] Field of Search ..... 493/71, 72, 81, 493/162, 177, 178, 179, 180, 182, 126, 127, 181

[56] References Cited

U.S. PATENT DOCUMENTS 2,896,517 7/1959 Labombarde .

4,012,996 3/1977 Stolkin ..... 492/162

4,319,878 3/1982 Dozier ..... 493/177

*Primary Examiner*—Jack W. Lavinder

*Attorney, Agent, or Firm*—Felfe & Lynch

[57] ABSTRACT

Unitary blank includes a shroud blank and a tray blank connected by webs therebetween. The unitary blank is folded along a first line of demarcation so that the web overlaps the shroud blank, then along a parallel second line of demarcation so that the tray overlaps the web and the shroud. End portions are then folded toward a center line running perpendicular to the lines of demarcation to form a unitary preform for a two part shipping and display container. According to one embodiment the tray blank is provided with handles and the unitary blank is folded so that the tray blank is outside the shroud blank.

7 Claims, 6 Drawing Sheets

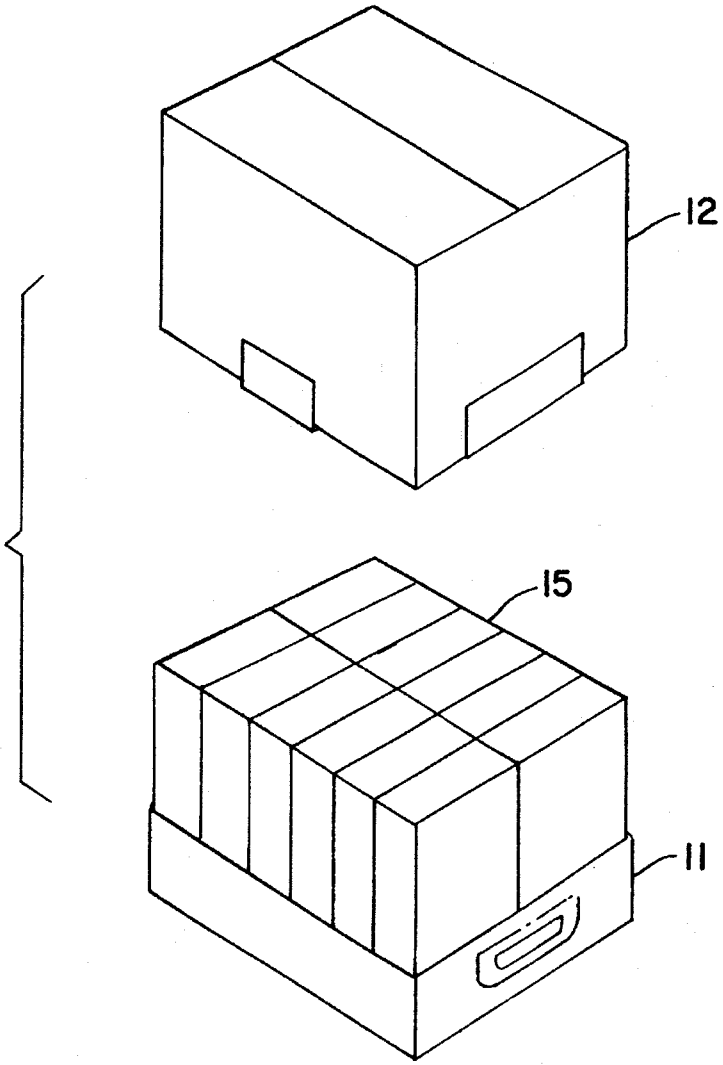
FIG. 3
FIG. 1
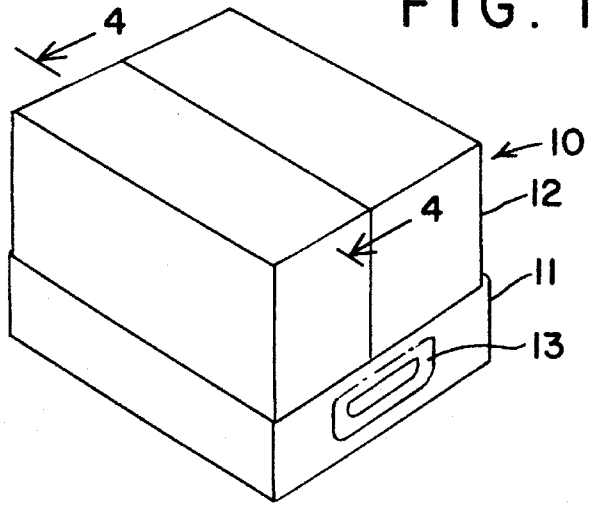
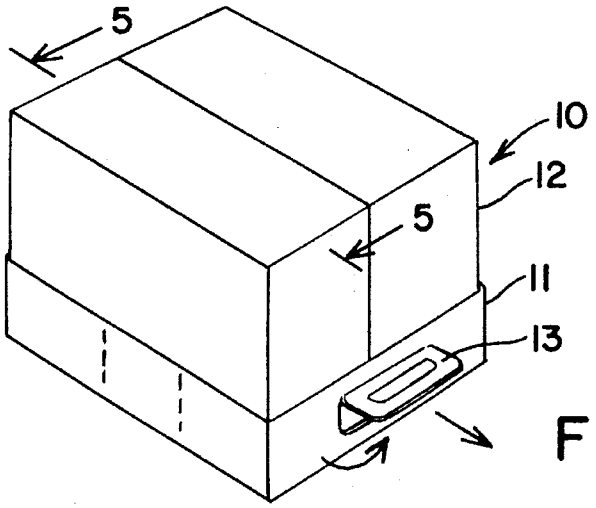
FIG. 2

METHOD OF MAKING A KNOCKED-DOWN FLAT PREFORM FOR A SHIPPING AND DISPLAY CONTAINER

BACKGROUND OF THE INVENTION

This invention relates to a method of making a knocked-down flat preform for a regular slotted shipping and display container having a tray and a shroud. A regular slotted container is a universal case or box. Functionally, the container is a two-part case in which one part is a shroud and one part is a tray and the shroud is separable from the tray which serves as a displayable case.

The invention relates to a method of making a shipping and display container comprising multiple parts assembled in such a manner as to provide a display tray as part of the container which can be packed on conventional regular slotted container brand (RSC) case packers. This eliminates the need for special case packing equipment such as tray formers, tray makers and lidders to produce a displayable container. Also, only one knocked-down flat (KDF) magazine may be utilized associated with the method of the present invention.

It is an object of the invention to provide a new and improved method of making a preform for a regular slotted shipping and display container having a tray and a shroud which is adapted for use with a conventional regular slotted container case packer.

SUMMARY OF THE INVENTION

In accordance with the invention, a method of making a preform for a knocked-down flat regular slotted shipping and display container having a tray and a shroud comprises forming a unitary flat blank having shroud side walls and top flaps attached to the shroud by webs. The method includes (a) folding a blank portion comprising the tray down and back with respect to a blank portion comprising the shroud, and (b) folding a blank portion comprising the tray and the webs forward with the webs and the tray partially overlapping the sidewalls of the shroud.

Also in accordance with the invention. The method includes (a) folding a blank portion comprising the tray and the webs up and back onto a blank portion comprising the shroud, and (b) folding a blank portion comprising the tray forward onto the webs and leaving the shroud overlapping the side walls of the tray.

BRIEF DESCRIPTION OF THE DRAWINGS

FIG. 1 is a perspective view of a regular slotted shipping and display container constructed in accordance with the invention and in condition for shipping;

FIG. 2 is a perspective view of the FIG. 1 container with the handle portions outwardly rotated and raised;

FIG. 3 is an exploded perspective view of the FIG. 2 container showing a boxed product therein;

DESCRIPTION OF PREFERRED EMBODIMENTS

Figure 4:
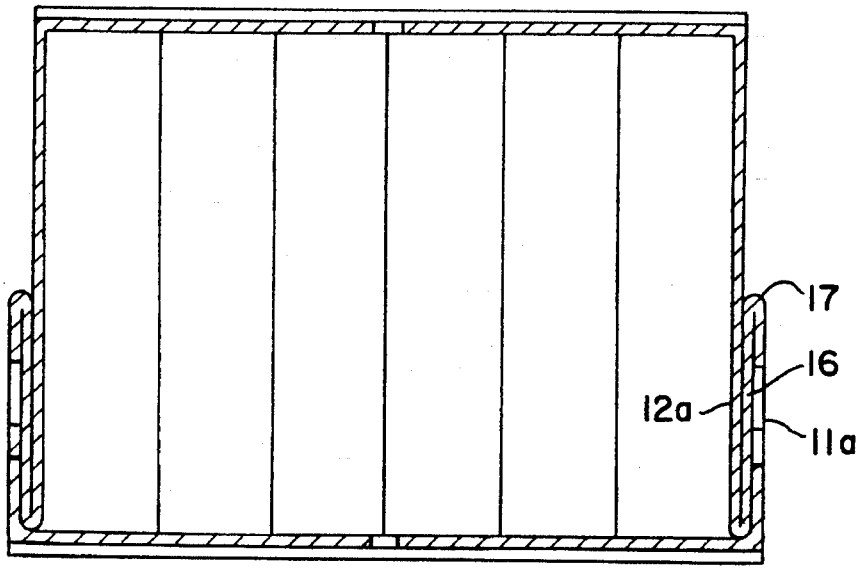
FIG. 4 is a sectional view of the FIG. 1 container taken along line 4—4 of FIG. 1.

Referring now more particularly to FIG. 1 of the drawings, there is represented a shipping and display container 10 having a tray 11 and a shroud 12. The tray 11 is positioned outside the shroud as will be more fully explained subsequently and the tray has a side having a handle portion 13 cut therein. The handle portion 13 is preferably die cut and is adapted to be grasped and rotated outwardly as represented in FIG. 2 for detaching the tray 11 from the web and the shroud as will be explained subsequently in connection with FIG. 5.

As represented in FIG. 3, when the tray is detached from the shroud the shroud 12 can be removed from the tray and the tray then serves as a display container for a boxed product 15.

Figure 5:
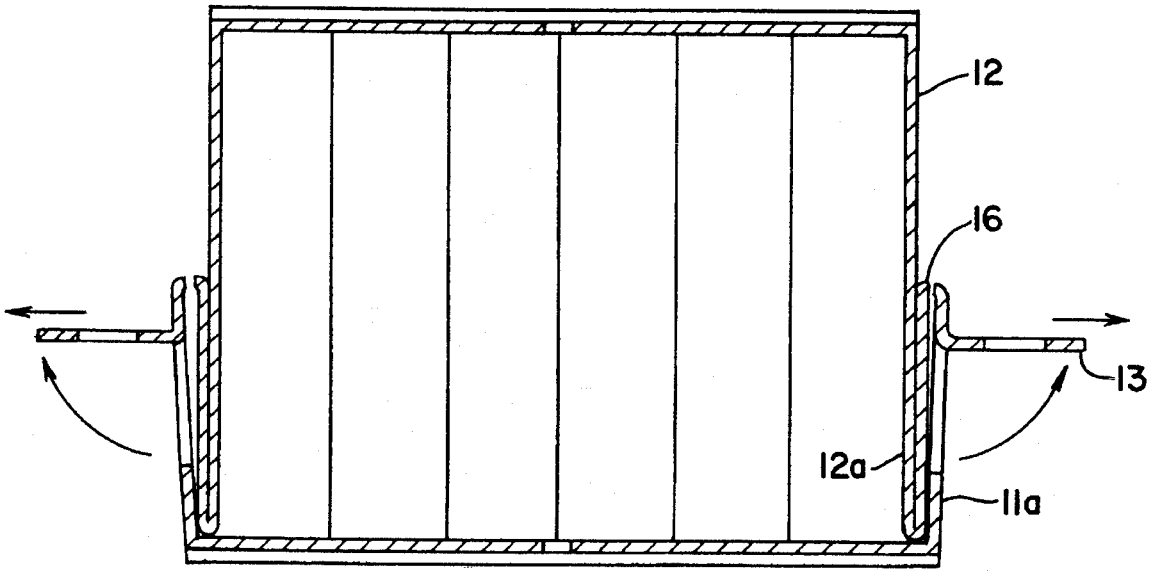
FIG. 5 is a sectional view of the FIG. 2 container taken along line 5—5 of FIG. 2.

Referring now more particularly to FIGS. 4 and 5, FIG. 4 is a cross sectional view of the FIG. 1 container representing the shroud 12 extending to the bottom of the tray 11 inside the tray 11. The shroud 12 is attached to the tray 11 by web 16. As represented in FIG. 5, when the handles 13 are pulled away from the shroud 12 the web 16 is broken along a frangible line of demarcation 17 and the shroud is thereby detached from the tray 11 and the web 16.

As may be seen in FIGS. 4 and 5, a portion 12*a* of the side wall of the shroud is coextensive with the side wall 11*a* of the tray. As will become apparent, the knocked-down flat blanks of the shroud and the tray are positioned such that the side walls of the tray blank overlie a portion of the side walls of the shroud blank.

Figure 6:
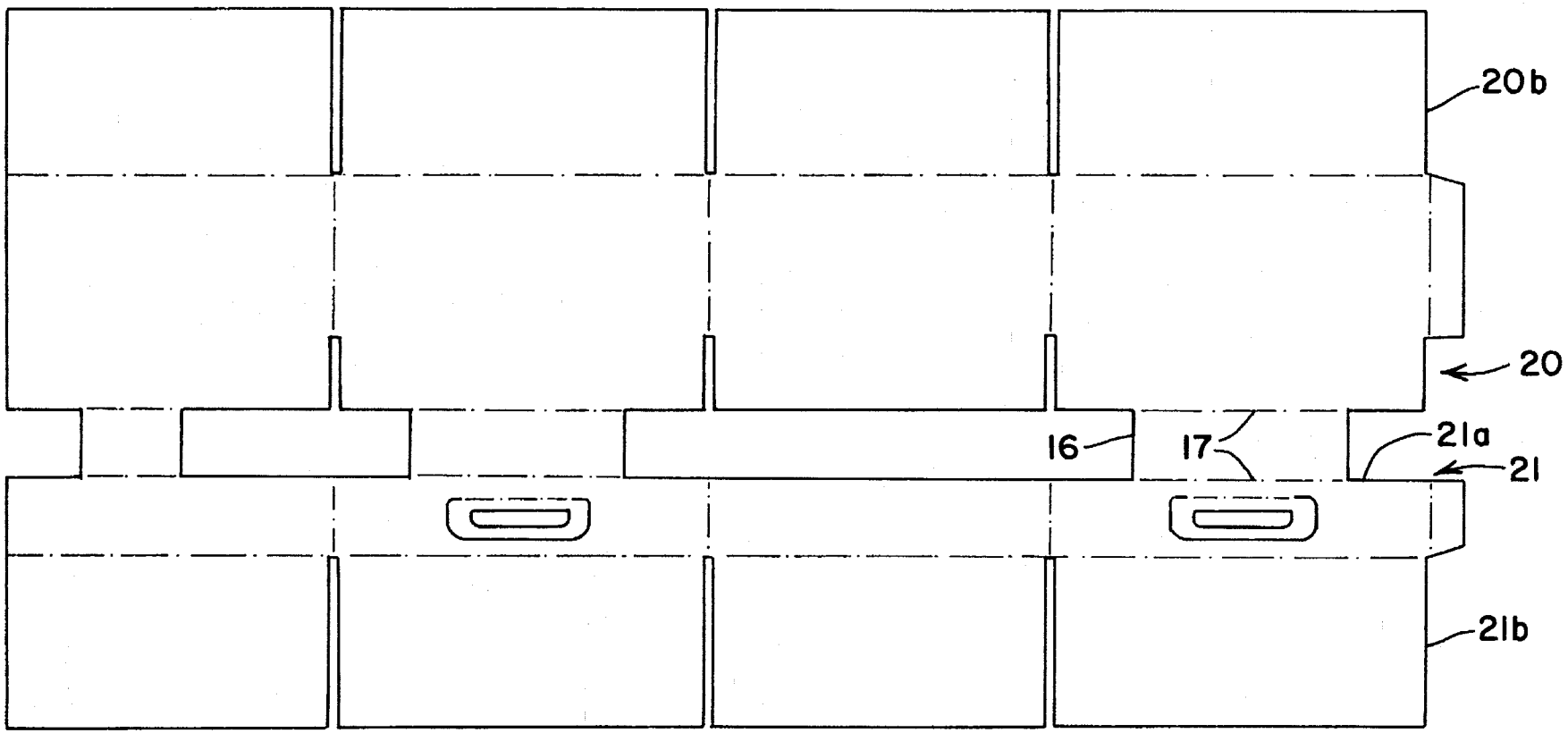
FIG. 6 is a plan view of a knocked-down flat shroud and a knocked-down flat tray attached by webs and utilized to form the FIG. 1 container.

FIG. 6 is a plan view of a unitary blank comprising a shroud blank 20 attached to a tray blank 21 by webs 16 having lines of demarcation 17.

Figure 7:
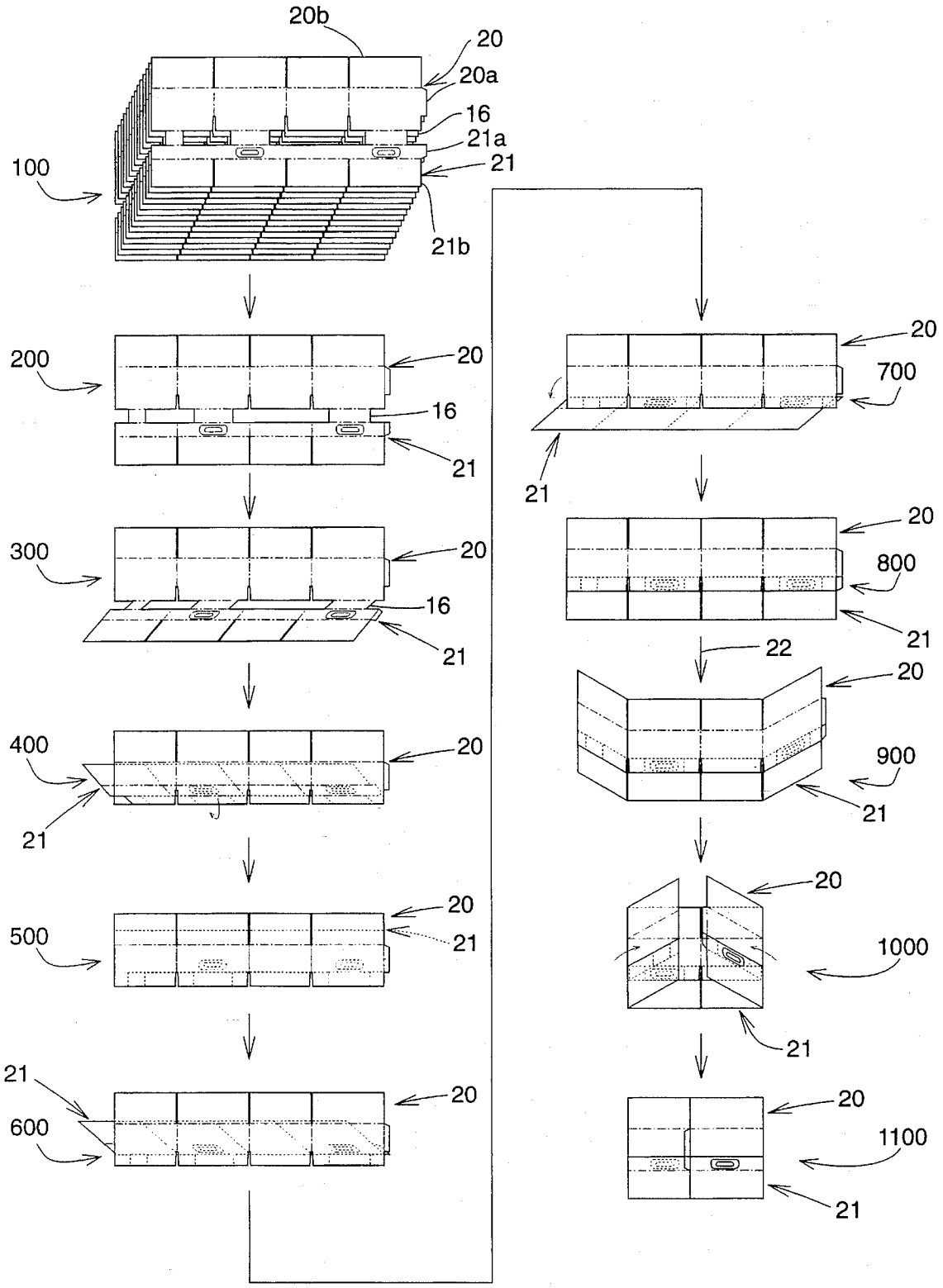
FIG. 7 is a composite exploded perspective view of shrouds and trays attached by webs individually utilized to form shipping and display containers of the FIG. 1 type and representing the steps in accordance with the invention which may be utilized in the manufacture of each container.

Referring now more particularly to FIG. 7, in accordance with the invention, a method of making a knocked-down flat preform for a regular slotted shipping and display container having a tray and a shroud comprises forming a unitary flat blank 20, 21, 16 (stages 100 and 200 show inside container surfaces) having shroud side walls 20*a* and top flaps 20*b* and having tray side walls 21*a* and bottom flaps 21*b*.

As represented in FIG. 7 at stages 300, 400, 500, 600, 700 800, the forming steps include (a) folding a blank portion tray blank 21 and webs 16 down and back with respect to the shroud blank 20, and (b) folding the tray blank 21 forward into the webs leaving the tray overlapping the side walls of the shroud.

End portions of the shroud blank 20 and tray blank 21 are then folded toward center line 22 (stages 900 and 1000) to form the finished preform (stage 1100) wherein the tray overlaps the shroud.

Figure 8:
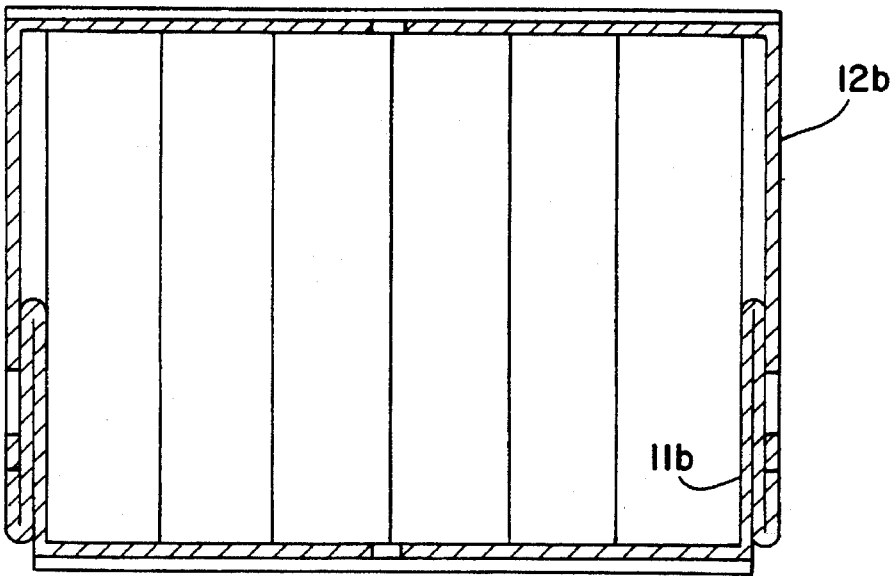
FIG. 8 is a sectional view of a container with a shroud outside a tray similar to the FIG. 4 view of the FIG. 2 container.
Figure 9:
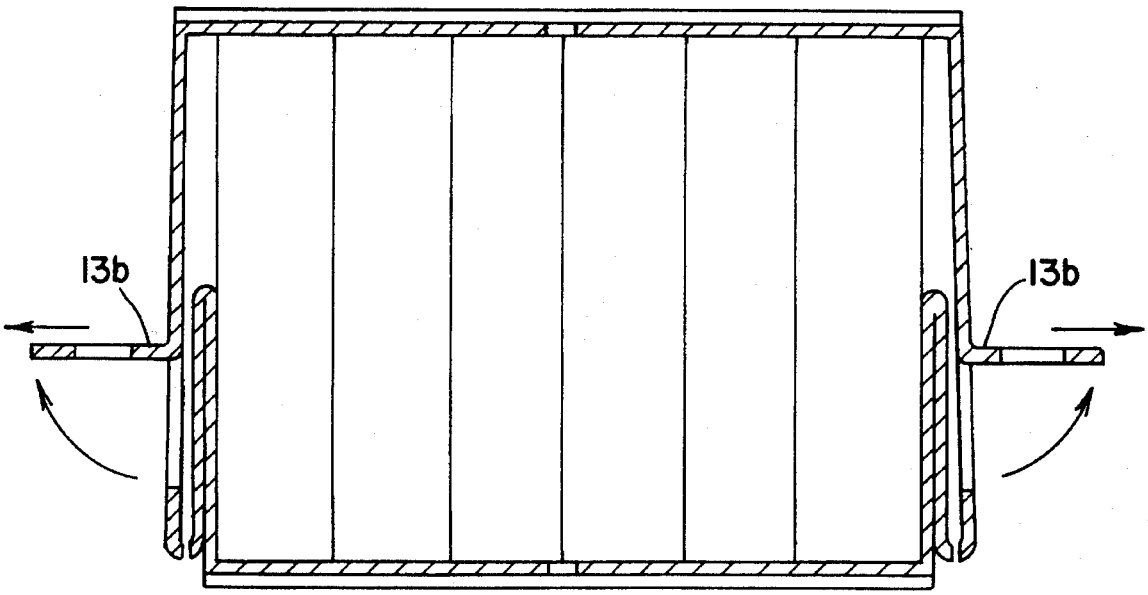
FIG. 9 is a sectional view of the FIG. 8 container and similar to the FIG. 5 view of the FIG. 2 container.

FIGS. 8 and 9 relate to another embodiment of the invention in which the shroud 12*b* is disposed over and outside the tray 11*b*. The handles 13*b*, as may be seen in FIG. 9, are attached to the shroud and form part of the shroud in a manner similar to the handles 13 of the tray 11 of FIG. 5.

Figure 10:
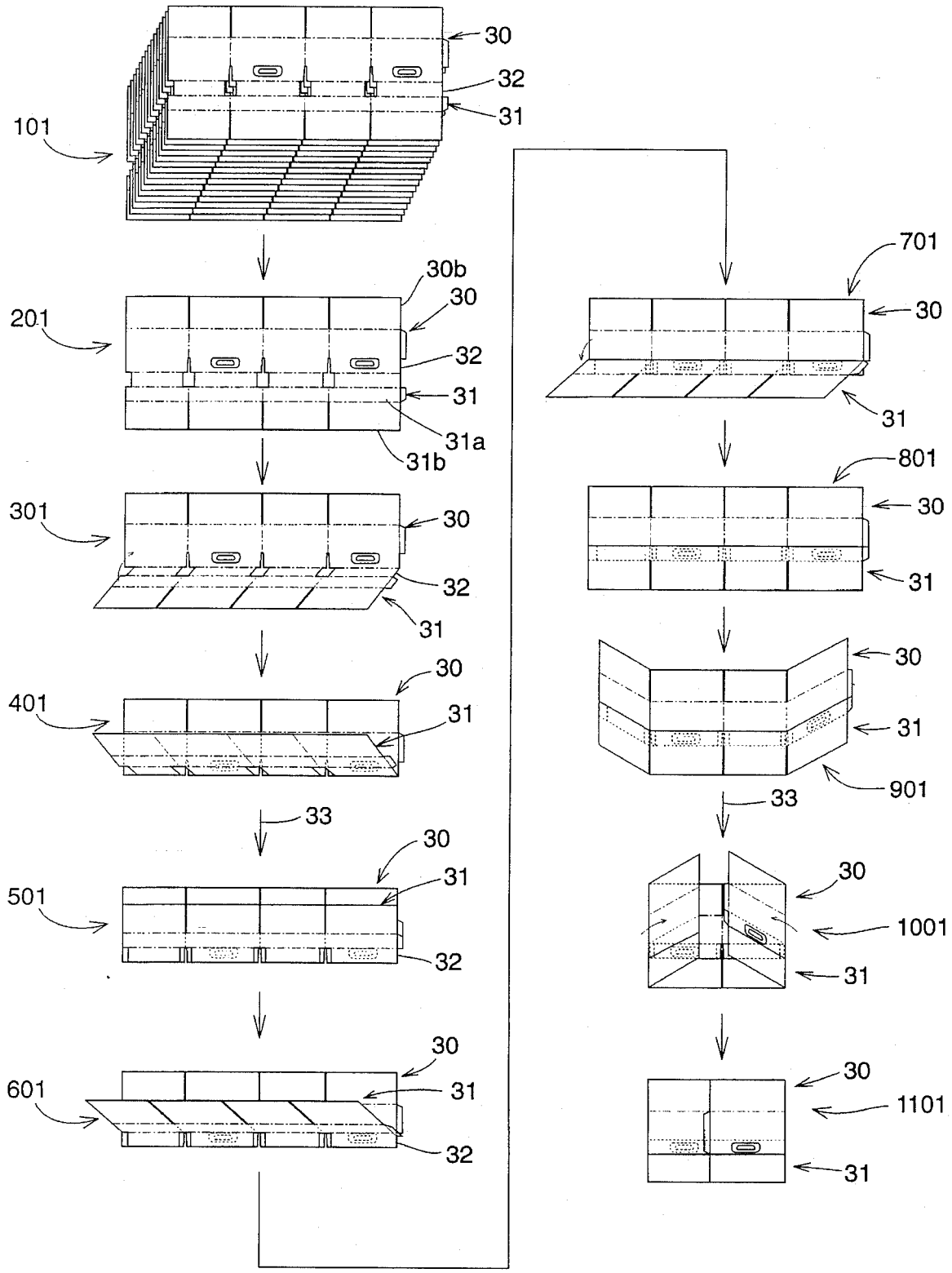
FIG. 10 is a composite exploded perspective view of knocked-down flat shrouds and trays attached thereto and individually utilized to form containers of the FIG. 9 type representing steps in accordance with the invention which may be utilized in the manufacture of each container.

Referring now more particularly to FIG. 10, in accordance with the invention, a method of making a knocked-down flat preform for regular slotted shipping and display container having a tray and shroud comprises forming a unitary blank 30, 31, 32 (FIGS. 10*a* and 10*b* which show inside container surfaces) having shroud side walls 30*a* and top flaps 30*b* and having tray side walls 31*a* and bottom flaps 31*b*.

As represented in stages 201–801, the forming steps include (a) folding a blank portion comprising the tray 31 and webs 32 forward onto the shroud blank 30 and (b) folding the tray blank 31 forward onto the webs 32 and leaving the shroud overlapping the side walls of the tray.

End portions of the shroud blank 20 and tray blank 21 are then folded toward each other (stages 901 and 1001) to form the finished preform (stage 1101) wherein the shroud overlaps the tray.

While there have been described what are considered to be the preferred embodiments of this invention, it will be obvious to those skilled in the art that various changes and modifications may be made therein without departing from the invention, and it is, therefore, aimed to cover all such changes and modifications as fall within the true spirit and scope of the invention.

What is claimed is:

1. Method of manufacturing a knocked-down flat preform for a two-part shipping and display container, said method comprising providing a unitary blank comprising a shroud blank, a tray blank, and web means therebetween, said web means being connected to said shroud blank and said tray blank at respective lines of demarcation, said unitary blank having a center line perpendicular to said lines of demarcation, folding said unitary blank along said lines of demarcation so that said shroud blank overlaps said web means and said tray blank, and folding end portions of said unitary blank toward said centerline and adhering said end portions to each other to form a unitary flat preform for a two-part shipping and display container.

2. Method as in claim 1 wherein said end portions are folded so that said tray blank is outside said shroud blank.

3. Method as in claim 2 wherein said tray blank is provided with handles.

4. Method as in claim 2 wherein said line of demarcation between said tray blank and said web means is frangible.

5. Method as in claim 1 wherein said end portions are folded so that said shroud blank is outside said tray blank.

6. Method as in claim 5 wherein said shroud blank is provided with handles.

7. Method as in claim 5 wherein said line of demarcation between said shroud blank and said web means is frangible.

* * * * *